US005663540A

United States Patent [19]

Inpyn

[11] Patent Number: 5,663,540

[45] Date of Patent: Sep. 2, 1997

[54] DOUBLE PIVOT POINT OVERTRAVEL SWITCH ACTUATOR

[75] Inventor: Carl A. Inpyn, Kinnelon, N.J.

[73] Assignee: Control Products, Inc., East Hanover, N.J.

[21] Appl. No.: 540,225

[22] Filed: Oct. 6, 1995

[51] Int. Cl.[6] ..... H01H 3/00; H01H 5/18

[52] U.S. Cl. ..... 200/17 R; 200/332.1

[58] Field of Search ..... 200/6 R, 17 R, 200/18, 47, 329–332.1, 337

[56] References Cited

U.S. PATENT DOCUMENTS

| | | | |
|---|---|---|---|
| 2,454,341 | 11/1948 | Repka | 200/332 |
| 2,817,725 | 12/1957 | Rochfort et al. | 200/47 |
| 3,418,610 | 12/1968 | Hammond | 335/205 |
| 3,484,572 | 12/1969 | Froyd | 200/332 |
| 3,869,690 | 3/1975 | Hickling | 200/332 X |
| 3,890,476 | 6/1975 | Canter et al. | 200/61.62 |
| 4,063,056 | 12/1977 | Baker | 200/332 |
| 4,295,017 | 10/1981 | Kashima et al. | 200/47 |
| 4,362,916 | 12/1982 | Anderson | 200/332 |
| 5,187,336 | 2/1993 | Lang et al. | 200/61.61 |

*Primary Examiner*—J. R. Scott
*Attorney, Agent, or Firm*—Richard M. Goldberg

[57] ABSTRACT

An overtravel switch actuator for actuating a switch exposed through a switch housing, includes a housing positioned in a vicinity of the exposed switch. The housing includes opposite side walls having opposite angled elongated slots therein. An actuating lever includes a first end, a second opposite end and an intermediate bent portion between the first and second ends, the bent portion being positioned to actuate the exposed switch. A pin is fixed to the first end of the lever and positioned in the elongated slots for pivotal movement in the slots and for movement along the slots. A double torsion spring is mounted between the housing and the pin and applies a force to the pin. The pin is retained in a substantially fixed position at one end of the slots when an external force is initially applied to the second end of the lever such that the lever pivots about the first end and the bent portion actuates the exposed switch. After actuation of the exposed switch by the bent portion and upon continued application of the external force to the second end of the lever, the pin moves along the slots such that the lever pivots about the bent portion, avoiding high stress placed on the bent area of the actuator lever during overtravel thereof.

20 Claims, 5 Drawing Sheets

DOUBLE PIVOT POINT OVERTRAVEL SWITCH ACTUATOR

BACKGROUND OF THE INVENTION

The present invention relates generally to switches, and more particularly, is directed to an overtravel switch actuator.

In a conventional click switch currently sold by the assignee of the present application, an actuator for the switch is comprised of a metal lever 10, as shown in FIG. 1, that is pivotally secured at one end 12 thereof to the housing for the switch by means of lever extension (not shown) formed thereat through which a pivot pin (not shown) extends. Metal lever 10 includes a convex intermediate bent portion 14 that is positioned above a circular hole in the housing and through which bent portion 14 is in contact with the upper surface of the click switch for actuating the same. The opposite end 16 of metal lever 10 is bifurcated and has a shaft (not shown) secured thereacross which rotatably receives a roller thereon. Since end 12 is at a fixed position on the housing, when the roller end 16 of lever 10 is depressed, lever 10 is pivoted about end 12 and bent portion 14 of lever 10 is forced down to actuate the switch, which emits a clicking sound as an audible indication of the actuation thereof.

However, a problem that results with such lever is that in many pieces of machinery in which this arrangement is used, the actuating machine part will force roller end 16 of lever 10 down to the metal housing during each actuation. Therefore, roller end 16 of lever 10 travels far past the point necessary to actuate the switch. As a result of this overtravel action, there is a tremendous amount of stress placed on lever 10, particularly around bent portion 14 thereof. Because of this, the life of lever 10 is severely reduced, that is, it fails in a shorter time than desired, by breaking at the high stress points.

FIG. 1 also shows the stress on lever 10 which is indicated by hatching to represent different colors. As shown, the red areas ($4.72\times10^5$ psi) 18 are the highest stress areas, followed by the yellow areas ($3.3\times10^5$ psi) 20, green areas ($2.36\times10^5$ psi) 22, light blue area ($9.43\times10^4$ psi) 24, and dark blue areas (no stress) 26. As shown, red areas 18 exist only at bent portion 14, and this is where there is failure that reduces the life of lever 10.

OBJECTS AND SUMMARY OF THE INVENTION

Accordingly, it is an object of the present invention to provide a double pivot point overtravel switch actuator that overcomes the aforementioned problems with the prior art.

It is another object of the present invention to provide a double pivot point overtravel switch actuator that seeks to avoid the high stress placed on the bent area of the actuator lever during overtravel thereof, while still permitting the actuator lever to operate the switch in the same manner as is conventional, that is, by using the same force necessary to operate the switch.

It is still another object of the present invention to provide a double pivot point overtravel switch actuator having a switch lever that pivots about one end thereof during a first portion of its travel to actuate a switch, and then, upon continued overtravel, pivots about its bent portion.

To achieve the latter pivoting movement about the bent portion of the lever, one end of the lever is mounted to a pivot pin that is positioned in elongated slots, with the pivot pin itself being spring biased by a separate spring.

It is yet another object of the present invention to provide a double pivot point overtravel switch actuator that is economical to manufacture and easy to use.

In accordance with an aspect of the present invention, an overtravel switch actuator for actuating a switch exposed through a switch housing, includes a housing positioned in a vicinity of the exposed switch; an actuating lever including a first end mounted with the housing, a second opposite end and an intermediate bent portion between the first and second ends, the intermediate bent portion being positioned to actuate the exposed switch; and spring means, mounted between the housing and the first end and applying a force to the first end, for (a) retaining the first end in a substantially fixed position relative to the housing when an external force is initially applied to the second opposite end of the actuating lever such that the actuating lever pivots about the first end and the intermediate bent portion actuates the exposed switch, and (b) permitting movement of the first end relative to the housing after actuation of the exposed switch by the intermediate bent portion and upon continued application of the external force to the second opposite end of the actuating lever such that the actuating lever pivots about the intermediate bent portion.

Specifically, the spring means includes a double torsion coil spring having a plurality of coils, a first extension connected with the coils and forming the first portion and at least one second extension connected with the coils and forming the second portion. Further, a pin is mounted to the housing, and the coils of the double torsion coil spring are mounted to the pin.

In addition, means are connected with the housing, for guiding the first end of the actuating lever in a predetermined path relative to the housing after actuation of the exposed switch by the intermediate bent portion and upon continued application of the external force to the second opposite end of the actuating lever such that the actuating lever pivots about the intermediate bent portion.

Still further, a roller is mounted to the second end of the actuating lever.

In accordance with another aspect of the present invention, an overtravel switch actuator for actuating a switch exposed through a switch housing, includes a housing positioned in a vicinity of the exposed switch, the housing including opposite elongated slots therein; an actuating lever including a first end, a second opposite end and an intermediate bent portion between the first and second ends, the intermediate bent portion being positioned to actuate the exposed switch; a pin fixed to the first end of the actuating lever and positioned in the elongated slots for pivotal movement in the slots and for movement along the slots; spring means mounted between the housing and the pin and applying a force to the pin, for (a) retaining the pin in a substantially fixed position at one end of the slots when an external force is initially applied to the second opposite end of the actuating lever such that the actuating lever pivots about the first end and the intermediate bent portion actuates the exposed switch, and (b) permitting movement of the pin along the slots after actuation of the exposed switch by the intermediate bent portion and upon continued application of the external force to the second opposite end of the actuating lever such that the actuating lever pivots about the intermediate bent portion.

The housing includes opposite side walls and a connecting wall which connects together the opposite side walls, each side wall including one elongated slot, with the elongated slots in the side walls being in alignment with each other. The elongated slots are angled relative to the housing so as to maintain the intermediate bent portion at a position immediately above the exposed switch during pivoting movement of the actuating lever about the first end thereof and about the intermediate bent portion thereof.

The above and other objects, features and advantages of the invention will become readily apparent from the following detailed description thereof which is to be read in connection with the accompanying drawings.

DETAILED DESCRIPTION

Figure 1:
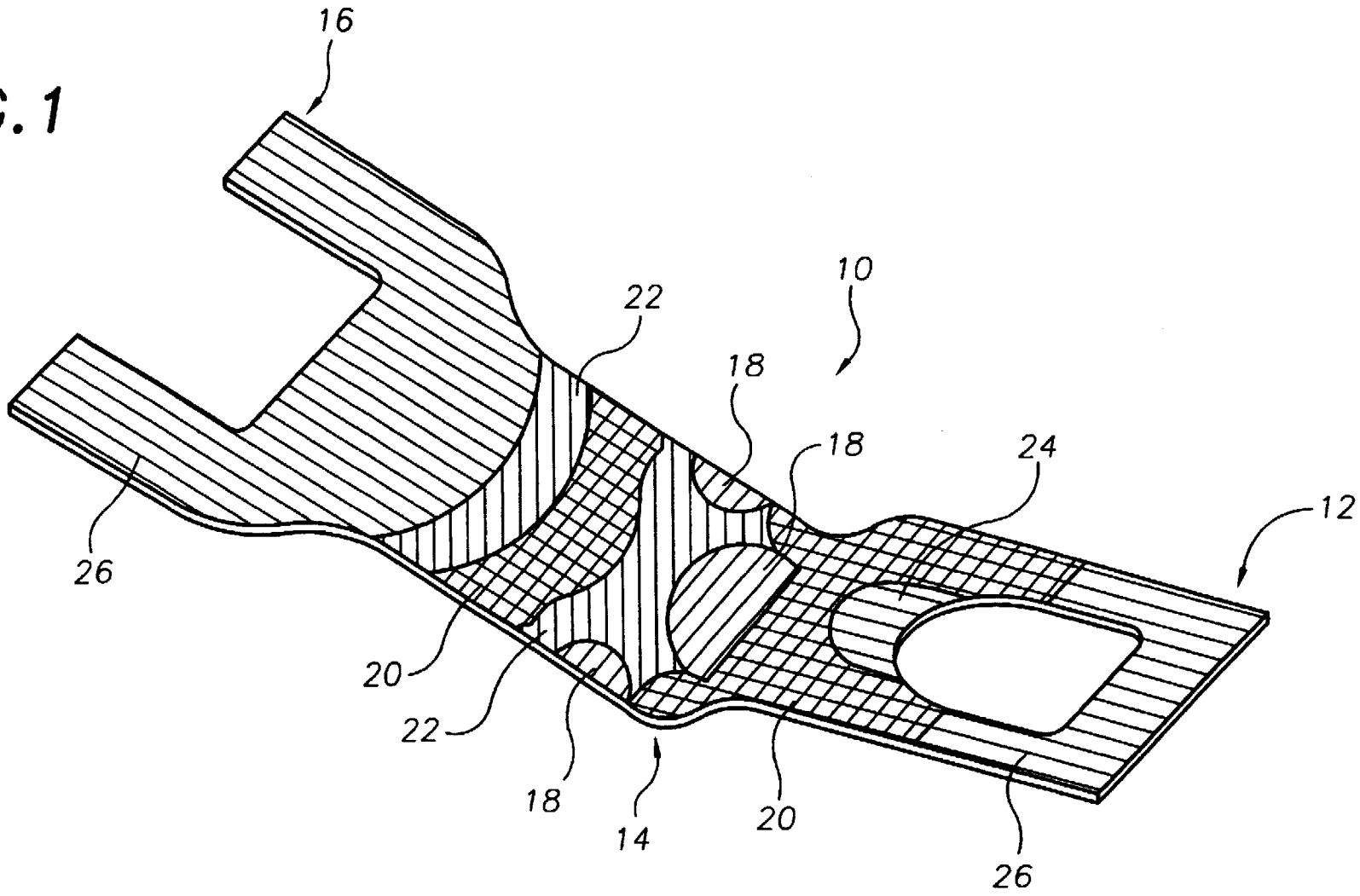
FIG. 1 is a perspective view of a conventional lever used with a click switch, in which the different hatchings represent different stresses of the lever during use.

Referring to the drawings in detail, the present invention seeks to avoid the high stress placed on the bent area of the actuator lever during overtravel thereof, while still permitting the actuator lever to operate the switch in the same manner as the prior art, that is, by using the same force necessary to operate the switch.

Specifically, as is conventional, a switch housing 30 is provided with a switch opening 32 therein through which a click switch 34 extends.

Figure 4:
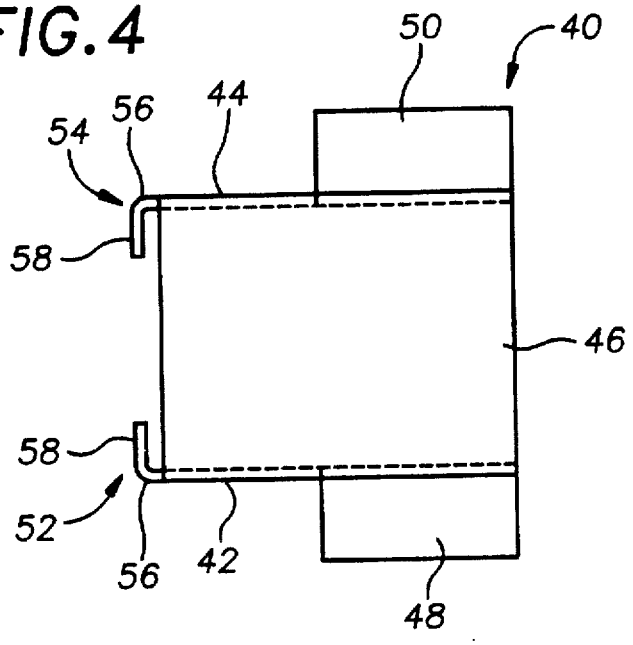
FIG. 4 is a top plan view of the actuator housing.
Figure 5:
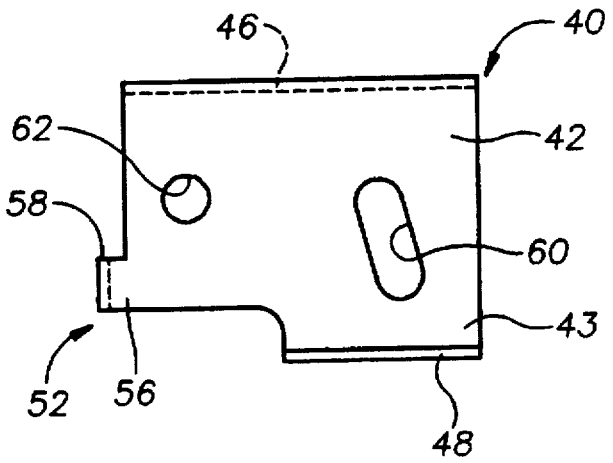
FIG. 5 is a side elevational view of the actuator housing, with the opposite side being a mirror image thereof.
Figure 6:
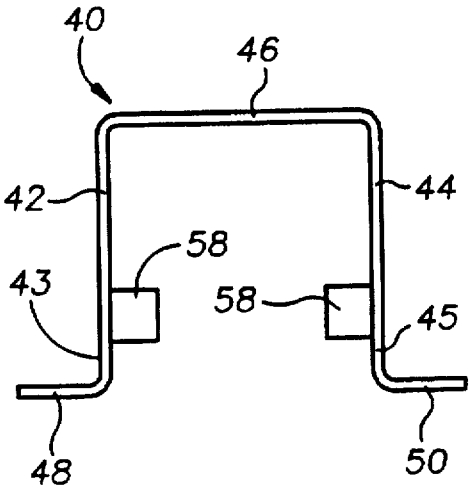
FIG.6 is a rear elevational view of the actuator housing.

Double pivot point overtravel switch actuator 38 according to the present invention includes an actuator housing 40 mounted on top of switch housing 30, immediately adjacent to switch opening 32 therein. As shown in FIGS. 4–6, actuator housing 40 includes two parallel, spaced apart upright side walls 42 and 44 connected together at upper ends thereof by a top connecting wall 46 so as to form an inverted U-shaped configuration. Side walls 42 and 44 each are formed in a generally rectangular configuration, having a lower rear extension 43 and 45, respectively, that extends downwardly from a rear half at a lower edge of side walls 42 and 44, and is integrally formed therewith.

Securing flanges 48 and 50 are integrally formed at the lower ends of lower rear extensions 43 and 45, respectively. Securing flanges 48 and 50 are oriented perpendicular to upright side walls 42 and 44 and extend outwardly of actuator housing 40. With this arrangement, securing flanges 48 and 50 are welded or otherwise secured to the upper surface of switch housing 30, so as to be positioned rearwardly of, and on opposite sides of switch opening 32.

Actuator housing 40 further includes inwardly turned tangs 52 and 54 formed as extensions at the front lower edge. Each tang 52 and 54 has a generally L-shaped configuration, with a connecting leg 56 extending forwardly from a lower portion of a front edge of each side wall 42 and 44, and an inwardly turned leg 58 that extends inwardly from the free end of the respective connecting leg 56. The purpose of tangs 52 and 54 is to prevent reverse pivoting action of the metal lever to be described hereinafter.

In addition, each upright side wall 42 and 44 is formed at a rear portion thereof with an elongated slot 60 that is angled in FIG. 5 with respect to the vertical by an angle of approximately 10 degrees. However, the present invention is not limited to this particular angle. Elongated slots 60 of upright side walls 42 and 44 are in alignment with each other.

Still further, each upright side wall 42 and 44 is formed at a front portion thereof with a circular opening 62 at a height corresponding generally to the upper end of the respective elongated slot 60.

Figure 3:
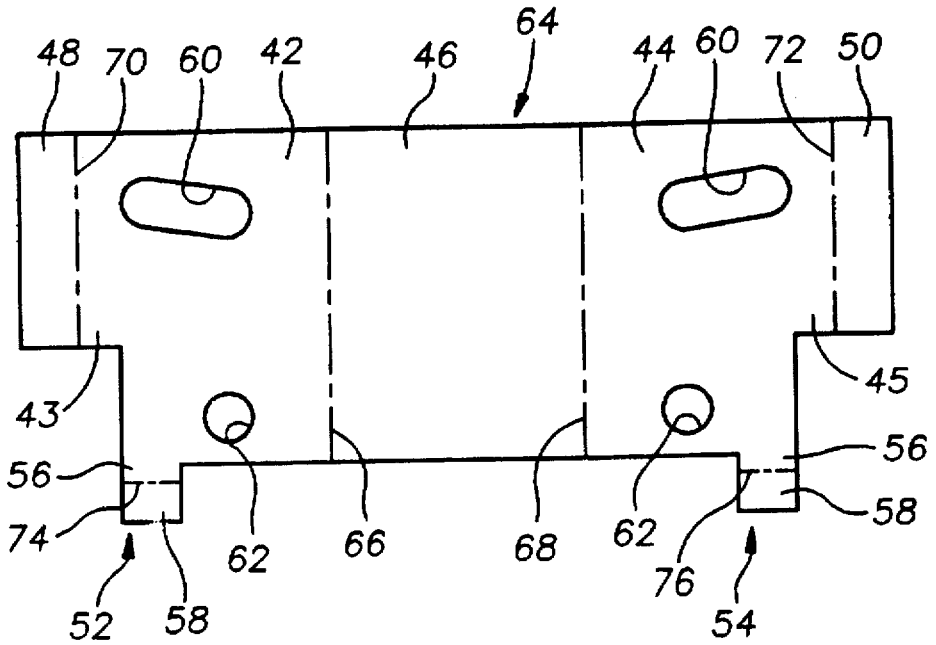
FIG. 3 is a plan view of the blank used to form the actuator housing.

A blank 64 from which actuator housing 40 is formed is shown in FIG. 3. As shown therein, blank 64 is bent about fold or bend lines 66 and 68 to form upright side walls 42 and 44 and connecting wall 46. Blank 64 is also bent about fold or bend lines 70 and 72 to define securing flanges 48 and 50. Finally, blank 64 is bent about fold or bend lines 74 and 76 to define tangs 52 and 54.

Double pivot point overtravel switch actuator 38 includes an actuator formed as a metal lever 78 that includes first and second opposite ends 80 and 82 and an convex intermediate bent portion 84.

Figure 9:
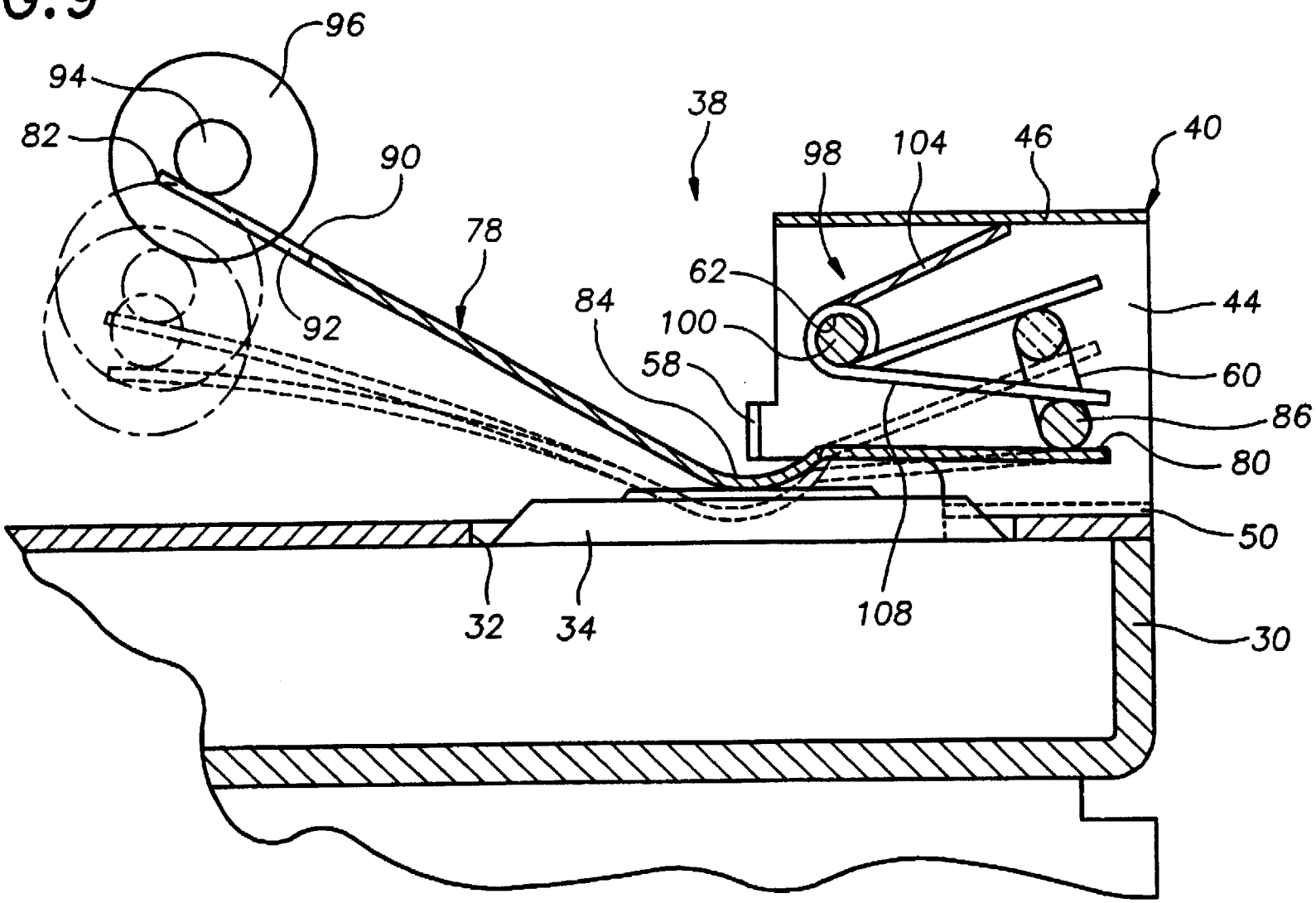
FIG. 9 is a lengthwise cross-sectional view of the double pivot point overtravel switch actuator of FIG. 2.

First end 80 has a pivot pin 86 fixed thereto, with pivot pin 86 mounted in opposite elongated slots 60 in upright side walls 42 and 44 of actuator housing 40. Thus, first end 80 of lever 78 can move between the upper and lower limits of slots 60, as shown in FIG. 9. Specifically, pivot pin 86 is shown in solid lines in the non-activated state of overtravel switch actuator 38 at the lower limit or end of slots 60, while being shown in dashed lines in the overtravel mode of operation of switch actuator 38 at the upper limit or end of slots 60.

With first end 80 fixed to pivot pin 86, bent portion 84 is positioned above click switch 34 so as to actuate the same. The reason that elongated slots 60 are angled is to maintain bent portion 84 in substantially the same position over switch 34 at all times during movement of lever 78.

Opposite second end 82 of metal lever 78 is bifurcated to produce two carrying arms 88 and 90 with a gap 92 therebetween. A shaft 94 is fixed at opposite ends thereof to upper surfaces of carrying arms 88 and 90 so as to span gap 92. An actuating roller 96 is rotatably mounted on shaft 94 within gap 92.

Figure 10:
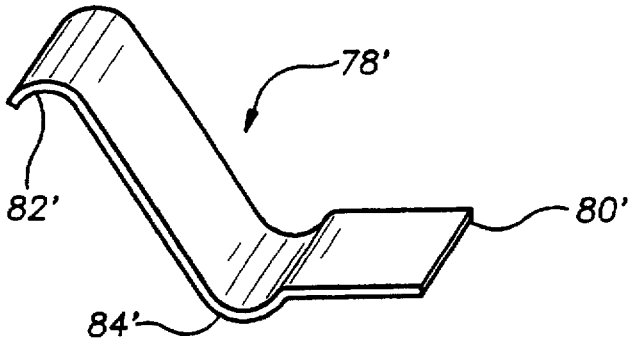
FIG. 10 is a perspective view of a modified metal lever that can be used with the present invention.

It will be appreciated that metal lever 78 may have configurations other than that already described. For example, as shown in FIG. 10, a modified metal lever 78' has a first end 80', a second end 82' and an intermediate bent portion 84'. Metal lever 78' differs from metal lever 78 at second end 82' thereof, which is not bifurcated. Instead, second end 82' is bent in an arcuate or curved shape that functions in a similar manner to roller 96.

Figure 11:
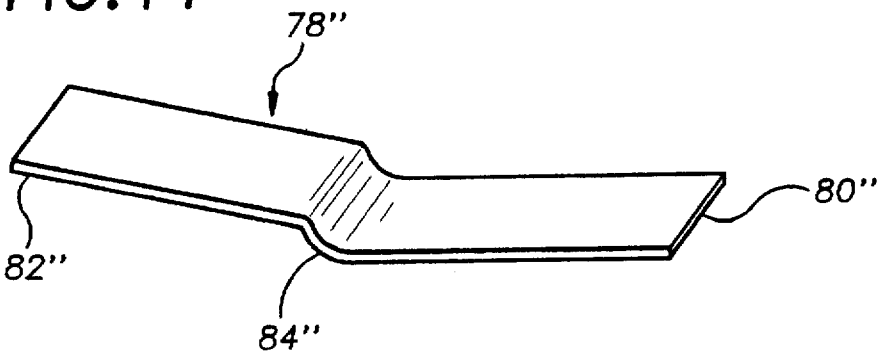
FIG. 11 is a perspective view of a further modified metal lever that can be used with the present invention.

As another example, FIG. 11 shows a modified metal lever 78" having a first end 80", a second end 82" and an intermediate bent portion 84". Metal lever 78" differs from metal lever 78 at second end 82" thereof, which is not bifurcated, but merely has a continuous flat portion.

Figure 2:
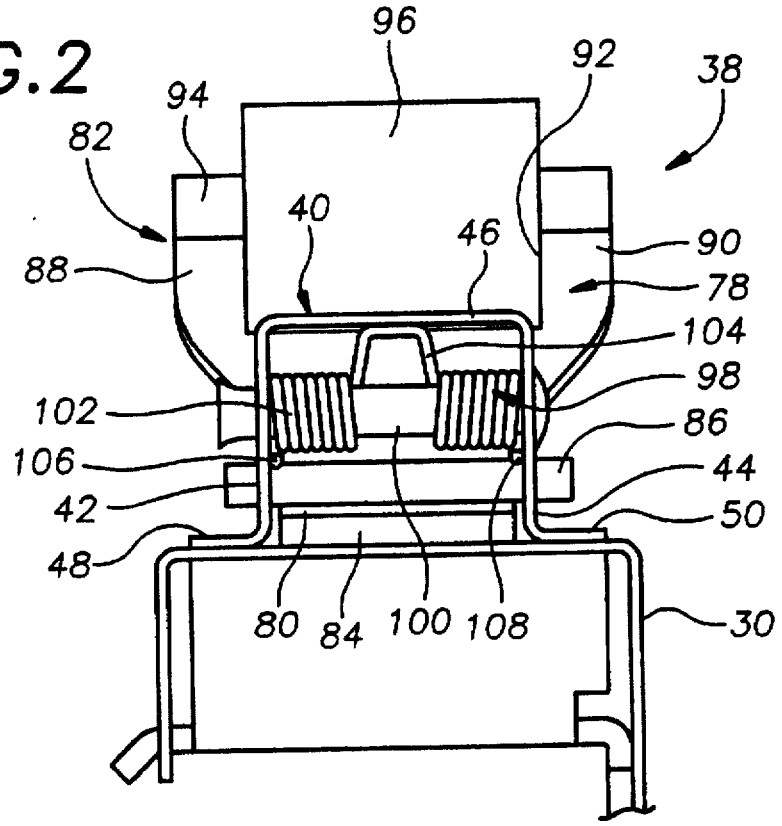
FIG. 2 is a rear elevational view of the double pivot point overtravel switch actuator according to the present invention.
Figure 7:
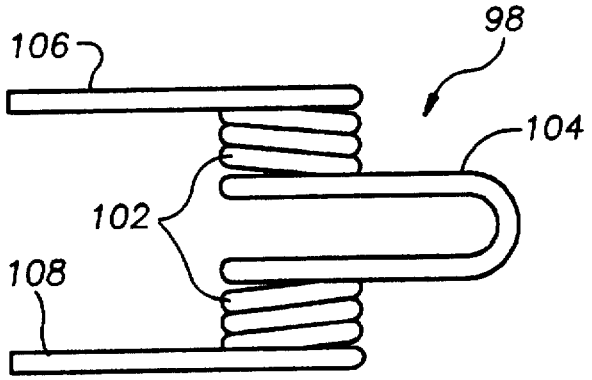
FIG. 7 is a top plan view of the double torsion spring in an unbiased stated.
Figure 8:
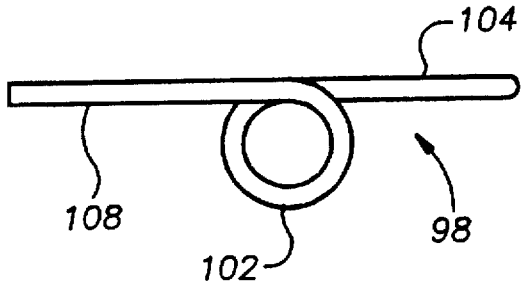
FIG. 8 is a side elevational view of the double torsion spring of FIG. 7.

In accordance with the present invention, a double torsion spring 98 is rotatably mounted on a pin 100 that extends through opposite circular openings 62 in upright side walls 42 and 44. FIGS. 7 and 8 show spring 98 in a free or unbiased position, while FIGS. 2 and 9 show spring 98 in its operative, biased position. As shown, spring 98 includes a plurality of wound coils 102 about a central axis, with a center extension 104 extending in one direction and end extensions 106 and 108 extending in the opposite direction, in an unbiased state.

In the assembled condition shown in FIGS. 2 and 9, end extensions 106 and 108 are forced around to the same side as center extension 104, so as to prestress spring 98. In this condition, center extension 98 abuts against the lower surface of connecting wall 46 of actuator housing 40, while end extensions 106 and 108 press down on pivot pin 86.

In operation, when roller 96 is first depressed from the upper solid line position in FIG. 9 to the intermediate dashed line position in FIG. 9, the spring force of spring 98 is greater than the force on lever 78. As a result, pivot pin 86 remains at the lower end of elongated slots 60. Thus, the same force as in conventional switch actuators is used to actuate switch 34. Accordingly, lever 78 pivots about pivot pin 86 and intermediate bent portion 84 is pressed down to actuate switch 34.

However, unlike the prior art, during continued movement of roller 96 from the intermediate dashed position to the lowermost dashed position in FIG. 9, that is, during overtravel of lever 78, the force applied to lever 78 is greater than that of spring 98, which thereby overcomes the force of spring 98. As a result, rather than lever 78 bending to a greater extent, with a consequent large stress on bent portion 84 as in the prior art, lever 78 instead pivots about bent portion 84, causing first end 80 of lever 78 and pivot pin 86 to move from a position at the lower end of slots 60 to a position at the upper end of slots 60, as shown by dashed lines in FIG. 9.

Because bent portion 84 does not have a large stress factor due to overtravel of lever 78, the life thereof is greatly improved.

It will be appreciated that various modifications can be made to the present invention within the scope of the claims herein. For example, any other suitable spring can be substituted for double torsion spring 98, such as a flat formed spring, a compression spring, an extension spring and the like. It is only important that the spring function to retain pin 86 in a substantially fixed pivoting position at one end of elongated slots 60 when an external force is initially applied to second opposite end 82 of actuating lever 78 such that actuating lever 78 pivots about first end 80 and intermediate bent portion 84 actuates the exposed switch 34, and permits movement of pin 86 along elongated slots 60 after actuation of the exposed switch 34 by intermediate bent portion 84 and upon continued application of the external force to second opposite end 82 of actuating lever 78 such that actuating lever 78 pivots about intermediate bent portion 84.

As another example, although elongated slots 60 have been shown for guiding movement of pin 86 during overtravel of lever 78, any other suitable guiding means can be provided.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. An overtravel switch actuator for actuating a switch exposed through a switch housing, comprising:

a housing positioned in a vicinity of said exposed switch;

an actuating lever including a first end mounted with said housing, a second opposite end and an intermediate bent portion between said first and second ends, said intermediate bent portion being positioned to actuate said exposed switch; and spring means, mounted between said housing and said first end and applying a force to said first end, for:

retaining said first end in a substantially fixed position relative to said housing when an external force is initially applied to said second opposite end of said actuating lever such that said actuating lever pivots about said first end and said intermediate bent portion actuates said exposed switch, and permitting movement of said first end relative to said housing after actuation of said exposed switch by said intermediate bent portion and upon continued application of said external force to said second opposite end of said actuating lever such that said actuating lever pivots about said intermediate bent portion.

2. An overtravel switch actuator according to claim 1, wherein said spring means includes a first portion in force applying engagement with said housing and a second portion in force applying engagement with said first end of said actuating lever.

3. An overtravel switch actuator according to claim 2, wherein said spring means includes a double torsion coil spring having a plurality of coils, a first extension connected with said coils and forming said first portion and at least one second extension connected with said coils and forming said second portion.

4. An overtravel switch actuator according to claim 3, wherein a pin is mounted to said housing, and said coils of said double torsion coil spring are mounted to said pin.

5. An overtravel switch actuator according to claim 1, further comprising means, connected with said housing, for guiding said first end of said actuating lever in a predetermined path relative to said housing after actuation of said exposed switch by said intermediate bent portion and upon continued application of said external force to said second opposite end of said actuating lever such that said actuating lever pivots about said intermediate bent portion.

6. An overtravel switch actuator according to claim 1, further comprising a roller mounted to said second end of said actuating lever.

7. An overtravel switch actuator according to claim 1, wherein said second end of said actuating lever is bent in an arcuate shape.

8. An overtravel switch actuator for actuating a switch exposed through a switch housing, comprising:

a housing positioned in a vicinity of said exposed switch, said housing including opposite elongated slots therein;

an actuating lever including a first end, a second opposite end and an intermediate bent portion between said first and second ends, said intermediate bent portion being positioned to actuate said exposed switch;

a pin fixed to said first end of said actuating lever and positioned in said elongated slots for pivotal movement in said slots and for movement along said slots;

spring means mounted between said housing and said pin and applying a force to said pin, for:

retaining said pin in a substantially fixed position at one end of said slots when an external force is initially applied to said second opposite end of said actuating lever such that said actuating lever pivots about said first end and said intermediate bent portion actuates said exposed switch, and permitting movement of said pin along said slots after actuation of said exposed switch by said intermediate bent portion and upon continued application of said external force to said second opposite end of said actuating lever such that said actuating lever pivots about said intermediate bent portion.

9. An overtravel switch actuator according to claim 8, wherein said housing includes opposite side walls and a connecting wall which connects together said opposite side walls, each said side wall including one said elongated slot, with said elongated slots in said side walls being in alignment with each other.

10. An overtravel switch actuator according to claim 8, wherein said elongated slots are angled relative to said housing so as to maintain said intermediate bent portion at a position immediately above said exposed switch during pivoting movement of said actuating lever about said first end thereof and about said intermediate bent portion thereof.

11. An overtravel switch actuator according to claim 8, wherein said spring means includes a first portion in force applying engagement with said housing and a second portion in force applying engagement with said pin.

12. An overtravel switch actuator according to claim 11, wherein said spring means includes a double torsion coil spring having a plurality of coils, a first central extension connected with said coils and forming said first portion and at least one second end extension connected with said coils and forming said second portion.

13. An overtravel switch actuator according to claim 12, wherein a further pin is mounted to said housing, and said coils of said double torsion coil spring are mounted to said further pin.

14. An overtravel switch actuator according to claim 8, further comprising a roller mounted to said second end of said actuating lever.

15. An overtravel switch actuator according to claim 8, wherein said second end of said actuating lever is bent in an arcuate shape.

16. An overtravel switch actuator for actuating a switch exposed through a switch housing, comprising:

a housing positioned in a vicinity of said exposed switch, said housing including:

opposite side walls, a connecting wall which connects together said opposite side walls, and an elongated slot in each said side wall, with said elongated slots in said side walls being in alignment with each other and being angled relative to said housing;

an actuating lever including a first end, a second opposite end and an intermediate bent portion between said first and second ends, said intermediate bent portion being positioned to actuate said exposed switch;

a pin fixed to said first end of said actuating lever and positioned in said elongated slots for pivotal movement in said slots and for movement along said slots;

spring means mounted between said housing and said pin and applying a force to said pin, for:

retaining said pin in a substantially fixed position at one end of said slots when an external force is initially applied to said second opposite end of said actuating lever such that said actuating lever pivots about said first end and said intermediate bent portion actuates said exposed switch, and permitting movement of said pin along said slots after actuation of said exposed switch by said intermediate bent portion and upon continued application of said external force to said second opposite end of said actuating lever such that said actuating lever pivots about said intermediate bent portion, said spring means including a first portion in force applying engagement with said housing and a second portion in force applying engagement with said pin.

17. An overtravel switch actuator according to claim 16, wherein said spring means includes a double torsion coil spring having a plurality of coils, a first central extension connected with said coils and forming said first portion and at least one second end extension connected with said coils and forming said second portion.

18. An overtravel switch actuator according to claim 17, wherein a further pin is mounted to said housing, and said coils of said double torsion coil spring are mounted to said further pin.

19. An overtravel switch actuator according to claim 16, further comprising a roller mounted to said second end of said actuating lever.

20. An overtravel switch actuator according to claim 16, wherein said second end of said actuating lever is bent in an arcuate shape.

* * * * *